US005882503A

United States Patent [19]

Bernhardt

[11] Patent Number: 5,882,503

[45] Date of Patent: Mar. 16, 1999

[54] ELECTROCHEMICAL FORMATION OF FIELD EMITTERS

[75] Inventor: Anthony F. Bernhardt, Berkeley, Calif.

[73] Assignee: The Regents of the University of California, Oakland, Calif.

[21] Appl. No.: 847,086

[22] Filed: May 1, 1997

[51] Int. Cl.[6] ..... C25F 3/00

[52] U.S. Cl. ..... 206/664; 445/50

[58] Field of Search ..... 204/4, 20; 205/122, 205/123, 664; 313/109; 445/24, 27, 50

[56] References Cited

U.S. PATENT DOCUMENTS

| | | | |
|---|---|---|---|
| 5,462,467 | 10/1995 | Macaulay et al. | 445/50 |
| 5,559,389 | 9/1996 | Spindt et al. | 313/310 |
| 5,578,185 | 11/1996 | Bergeron et al. | 205/123 |

OTHER PUBLICATIONS

Busta H. Heinz, "Vacuum Microelectronics–1992 Review"; Journal of Micromechanical Microeng; vol. 2; pp. 43–74, Jun. 1992.

J.K. Cochran et al, "Low voltage field emission from tungsten fiber arrays in a stabilized zirconia matrix"; Journal of Material Research; vol. 2 No. 3; pp. 322–325, Mar. 1987.

*Primary Examiner*—Arun S. Phasge
*Assistant Examiner*—Erica Smith-Hicks
*Attorney, Agent, or Firm*—L. E. Carnahan

[57] ABSTRACT

Electrochemical formation of field emitters, particularly useful in the fabrication of flat panel displays. The fabrication involves field emitting points in a gated field emitter structure. Metal field emitters are formed by electroplating and the shape of the formed emitter is controlled by the potential imposed on the gate as well as on a separate counter electrode. This allows sharp emitters to be formed in a more inexpensive and manufacturable process than vacuum deposition processes used at present. The fabrication process involves etching of the gate metal and the dielectric layer down to the resistor layer, and then electroplating the etched area and forming an electroplated emitter point in the etched area.

10 Claims, 3 Drawing Sheets

ELECTROCHEMICAL FORMATION OF FIELD EMITTERS

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to field emitters, particularly to field emission cathodes for flat panel displays, and more particularly to processes for fabricating field emitting points in a gated field emitter structure.

Flat panel displays are forecast to be a 10–20 billion dollar per year market by the turn of the century. Currently the flat panel displays primarily involve active matrix liquid crystals. Flat panel displays can be fabricated using field emission cathodes. Field emission is one of the leading contenders to replace today's active matrix liquid crystal displays and capture the bulk of this market.

Currently field emitters are fabricated using vacuum deposition. This process involves etching an opening in the gate metal and the dielectric down to the cathode or resistor layer, and then metal is plated onto the resistor layer which forms a pointed emitter on the resistor layer, thus producing a field emission cathode.

SUMMARY OF THE INVENTION

It is an object of the present invention to provide field emitting points in a gated field emitter structure.

A further object of the invention is to provide electrochemical formation of field emitters.

Another object of the invention is to provide processes for fabricating metal emitters by electroplating and controlling the shape of the emitters by the potential imposed on the gate and on a separate counter electrode.

Another object of the invention is to provide processes for forming sharp emitters in a more inexpensive and manufacturable manner than vacuum deposition processes used at present.

Another object of the invention is to provide a process for use in manufacturing flat panel displays using field emission cathodes.

Other objects and advantages of the present invention will become apparent from the following description and accompanying drawings. Basically the invention involves the formation of sharp or pointed field emitters in a gated field emission structure, such as used flat panel displays incorporating in field emission cathodes. The invention involves processes in the fabrication of field emitter cathodes, wherein pointed or sharp field emitters are formed on the resistor layer of the structure after etching an opening in the metal gate layer and the dielectric layer between the gate and resistor layers. The metal emitters are formed by electroplating, and the shape of the formed emitter is controlled by the potential imposed on the gate as well as on a separate counter electrode or by using the gate metal as a counter electrode. This allows sharp or pointed emitters to be formed in a less expensive and manufacturable manner than the currently used vacuum depositing processes.

BRIEF DESCRIPTION OF THE DRAWINGS

The accompanying drawings, which are incorporated into and form a part of the disclosure, illustrate embodiments which provide an understanding of the processes of the invention and, together with the description, serve to explain the principles of the invention.

DETAILED DESCRIPTION OF THE INVENTION

The invention is directed to the fabrication of field emitting points in a gated field emitter structure, such as field emission cathodes for use in flat panel displays. Metal emitters are formed by electroplating and the shape of the formed emitter is controlled by the potential imposed on the gate electrode and on a separate counter electrode or by using the gate metal as a counter electrode. This allows sharp emitters to be formed in a less expensive and manufacturable technique than vacuum deposition processes currently used.

Figure 3:
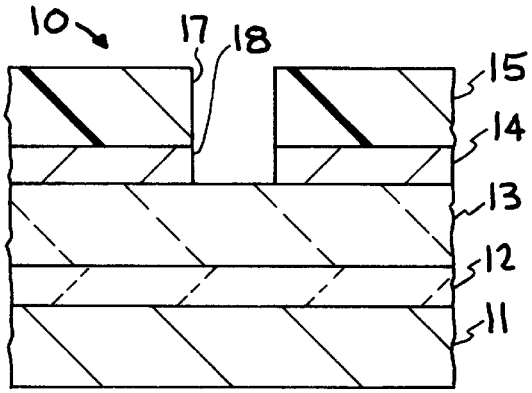

The processes of this invention up to and including the gate etch (FIGS. 3 and 9) described hereinafter, are similar to the microgate process currently used by commercial companies, such as Silicon Video Corporation, in manufacturing gated field emitter structures. The invention lies in the process for producing sharp emitters by electroplating and controlling the shape by controlling the electroplating potential, as described in detail hereinafter.

Figure 1:
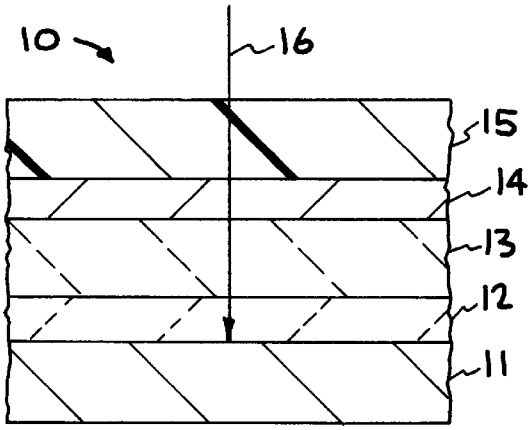
FIGS. 1–6 illustrate the operation steps made in accordance with one method of the present invention for fabricating a sharp field emitter.
Figure 2:
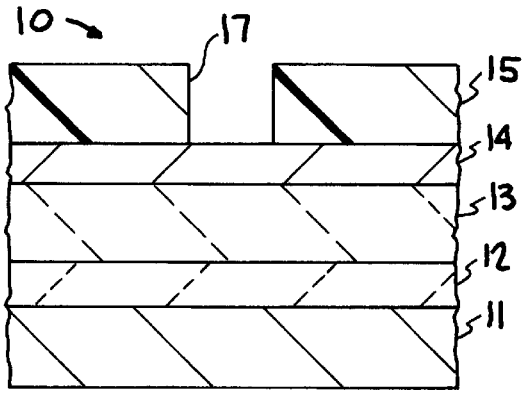
Figure 5:
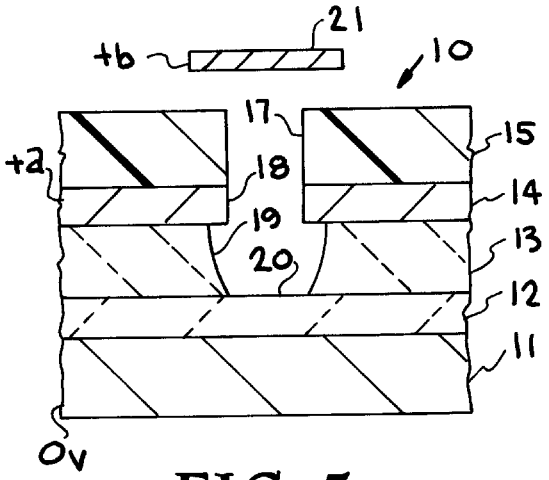
Figure 6:
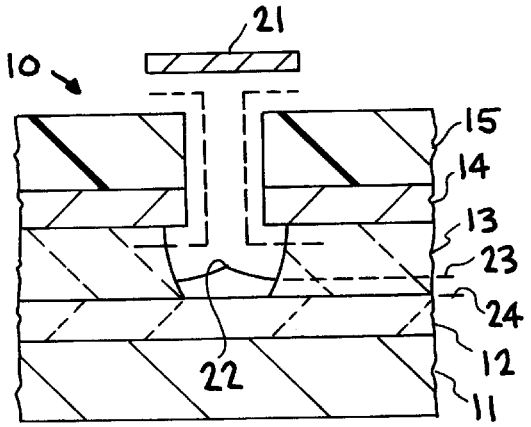
Figure 7:
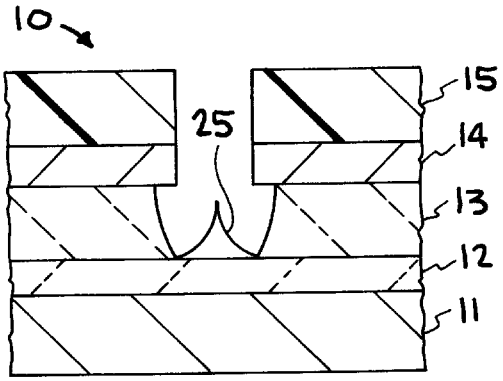
FIG. 7 illustrates an embodiment or a sharp (pointed) field emitter made in accordance with the FIGS. 1–6 process of the present invention.

A first process for electrochemical formation of field emitters is described hereinafter in conjunction with FIGS. 1–6, with an embodiment of the thus produced emitting point illustrated in FIG. 7. This process involves:

1. Forming a structure, generally indicated at 10, as shown in FIG. 1, composed of a row metal layer 11, such as chromium, a resistor metal or conductive layer 12, such as a cermet, a dielectric layer 13, such as silicon dioxide, a gate metal layer 14, such as chromium, and a polymer layer 15, such as polycarbonate. By way of example, the row metal layer 11 may also be composed of nickel, aluminum or copper, with a thickness of 200 nm to 2 $\mu$m; resistor layer 12 may also be composed of silicon or silicon carbide, with a thickness of 100 nm to 500 nm; dielectric layer 13 may additionally be formed of $Si_3N_4$ or $Al_2O_3$, with a thickness of 200 nm to 1 $\mu$m; the gate metal layer 14 may also be composed of molybdenum or aluminum, with a thickness of 50 nm to 500 nm; and the polymer layer 15 may also be formed of polyimide or $SiO_2$ with a thickness of 200 nm to 1 $\mu$m. The various layers (11–15) of structures 10 may be formed by various known deposition techniques which do not constitute part of this invention and details thereof are thus not deemed necessary for an understanding of the present invention.
2. Ion or nuclear tracks 16, only one shown in FIG. 1, are formed in the structure 10 so as to extend through the polymer layer 15 and the gate layer 14, as well as the dielectric layer 13 where certain types of dielectric material are used, as described below. The tracks 16 are formed by directing high energy particles onto the surface of polymer layer 15 with sufficient energy to penetrate down through the dielectric layer 13. The ion tracking may be carried out using the process described and claimed in copending application Ser. No. 08/851,258(IL-9705), filed May 5, 1997, entitled "Vapor Etching of Nuclear Tracks in Dielectric Materials". A detailed description is deemed unnecessary. By way of example, the energy required to penetrate the desired layers using $Xe^{+4}$ ions is dependent on the composition and thickness of the layers and may range from ~10 MeV to ~20 MeV.

Figure 4:
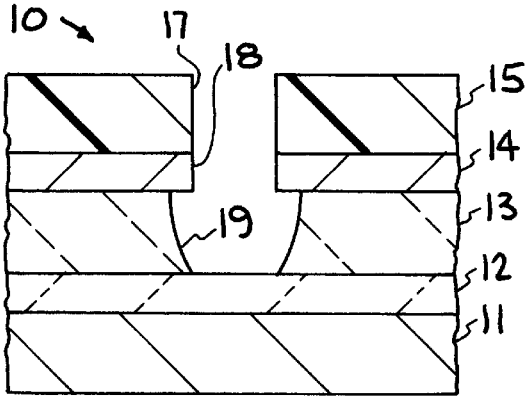

3. The areas of polymer layer 15 adjacent the nuclear tracks 16 are then etched to form openings, such as 17 shown in FIG. 2. If the layer 15 is composed of polycarbonate, for example, the etching is carried out using a 6M KOH solution at elevated temperature (<60° C.).
4. The areas of gate metal layer 14 beneath the openings 17 in polymer layer 15 are then etched using the polymer layer 15 as a mask to form openings such as 18 in FIG. 3. If the gate metal layer is composed of chromium, for example, the etching is carried out in a $Cl_2/O_2$ plasma.
5. The areas of the dielectric layer 13 located under the openings in the polymer and gate metal layers are then etched to form openings such as 19 in FIG. 4. The etching technique is dependent on the composition of the dielectric layer. The dielectric is etched either using the nuclear tracks 16 if there is a selective etch, but if the dielectric does not have a selective etch, or if it doesn't even track, a standard wet or dry etch can be used with the gate metal as a mask. For example, with the dielectric layer 13 composed of $SiO_2$. A non-selective etch is carried out by plasma etching with a $CHF_3/O_2$ gas mixture. The cavity in the dielectric can be widened with a buffered hydrofluoric acid etch if desired and as shown in FIG. 4.
6. Metal is then plated onto the exposed areas of resistor layer 12 as indicated at 20 in FIG. 5. This is accomplished using, for example, the gate metal layer 14 and a free-standing electrode 21 (see FIG. 5) as electrodes, in addition to the row metal of layer 11. The potentials on the row metal layer 11 is indicated at OV, on the gate metal layer 14 as +a, and on the free-standing electrode 21 as +b, as indicated in FIG. 5.
7. Plating of metal on the exposed areas 20 of resistor layer 12 will tend to follow potential surfaces and will cause the deposited metal to be pointed as indicated at 22, with equipotential surfaces being indicated by lines 23 and 24, as illustrated in FIG. 6. By way of example, the electroplating may be carried out in a nickel sulfamate plating solution. For an Al/Cr cermet resistor layer, plating can be enhanced by initial reduction of surface $Cr_2O_3$ using acidic nickel sulfate solution with pulsed voltage waveforms.
8. The shape of the thus formed emitter, illustrated at 25 in FIG. 7, is formed by controlling the potential imposed on the gate metal layer 14 as well as on the separate free-standing counter electrode 21. The emitter 25 may be formed of nickel, chromium, platinum, copper, or gold. For example, to produce the sharp pointed emitter configuration 25 of FIG. 7, the following potential control would involve a free-standing electrode at +0.8 to 1.2V, the resistor layer at OV, and the gate electrode potential depends on the difference in reduction potential between the gate material and the emitter metal and on the extent of emitter formation but generally falling between free-stand electrode and resistor layer potentials plus the difference in reduction potential of emitter and gate materials.

The following process, in conjunction with FIGS. 8–12, illustrates a process which differs from that of the FIGS. 1–7 process primarily in the formation of the emitter by electroplating without a free-standing electrode and in the widening of the dielectric cavity after formation of the emitter instead of before the emitter formation. The formation of a stack of films or layers to compose a complete field emitter device, as in the FIGS. 1–7 embodiment generally comprises a substrate, a metal layer, a resistor layer, an insulating layer and a gate metal layer. For simplification, in the FIGS. 8–12 embodiment, the illustrated structure omits the substrate and illustrates a row metal layer such as a conductive or resistive film, the insulation layer, the gate metal layer, etc. Control of the electroplating potential enables the formation of the emitter without shorting to the gate metal layer as described hereinafter.

Figure 8:
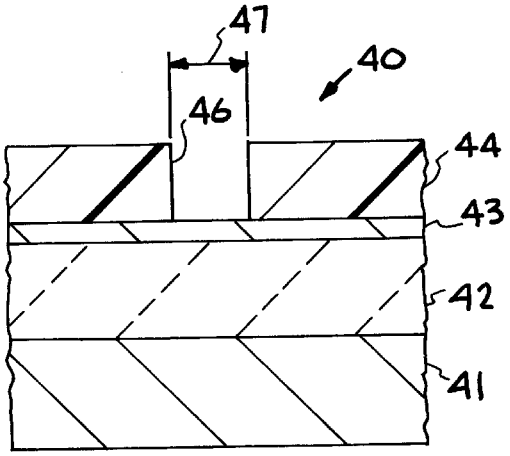
FIGS. 8–12 illustrate another method of the invention with FIG. 12 illustrating an embodiment of the end product of that method.
Figure 9:
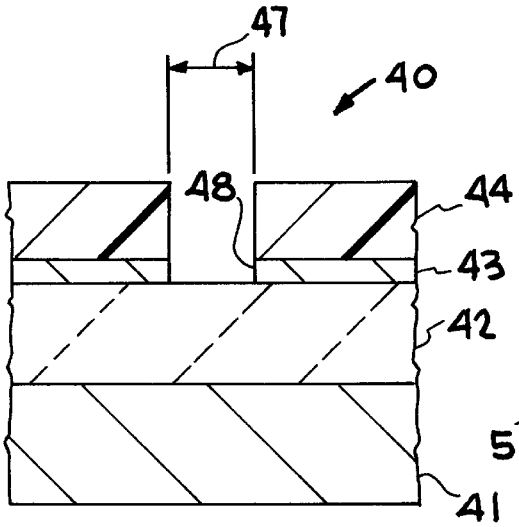
Figure 10:
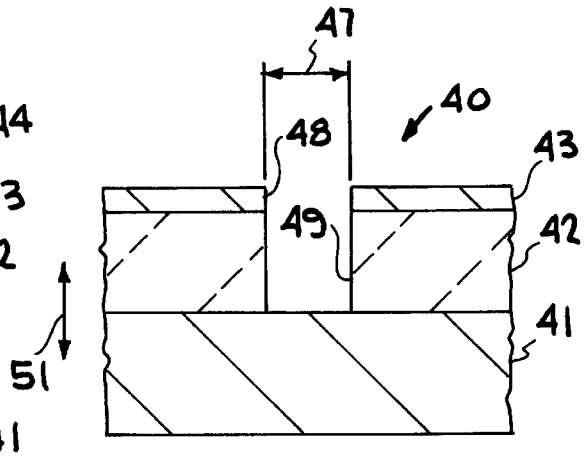
Figure 11:
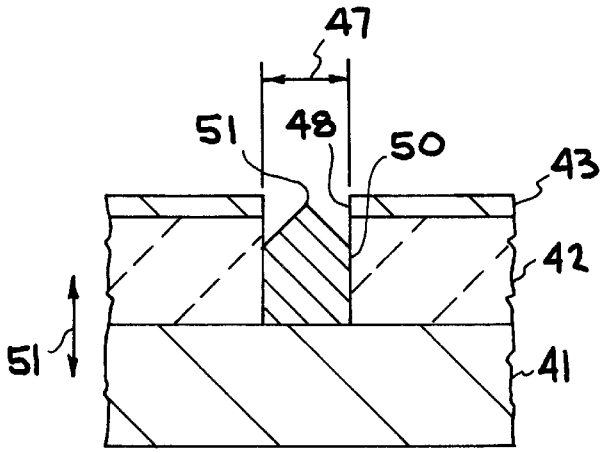
Figure 12:
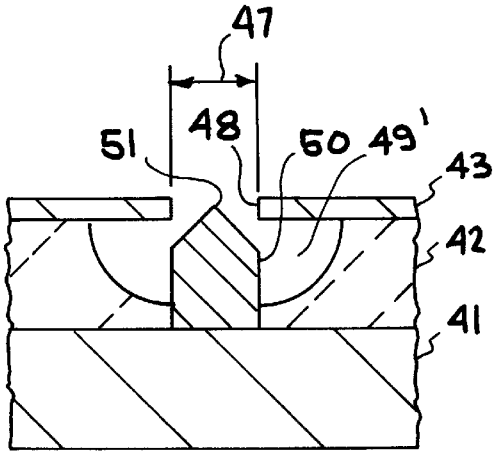

The process illustrated in FIGS. 8–12 is as follows, with FIG. 12 illustrating an embodiment of an end product produced by the process:

1. The formation of a stack of films or layers of materials to compose the field emitter device, with a mask layer or film on top, is shown in FIG. 8, and the structure, generally indicated at 40, is composed of a row metal such as conductive or resistive film 41, a dielectric or insulation film or layer 42, a gate material film or layer 43, and a mask layer or film 44. For example, the layer 41 may be composed of a conductive material, such as nickel, chromium, or aluminum, or a resistive material, such as cermet, silicon carbide, or amorphous silicon; the dielectric layer 42 may be composed of $SiO_2$, $Si_3N_4$, or $Al_3O_4$; the gate material layer 43 may be composed of metal or conductive material, such as chromium, aluminum, or molybdenum; and the mask layer 44 may be composed of an ion trackable polymer, polycarbonate or polyimide; an ion trackable inorganic dielectric such as $SiO_2$; or an ion trackable photoresist, such as AZ4110 made by Hoechst-Celanese. The structure of FIG. 8 may, for example, be composed of a resistive layer 41 of cermet having a thickness of 300 nm, a dielectric layer 42 of $SiO_2$ having a thickness of 400 nm, a gate metal layer 43 of chromium having a thickness of about 50 nm, and a mask layer 44 of polycarbonate having a thickness of 600 nm.
2. A pattern of nuclear tracks is formed in the mask layer 44 and these nuclear tracks are etched to form vias or openings, one such via being illustrated at 46 in FIG. 8, having a diameter of 50–200 nm as indicated by arrow 47. The etched tracks in mask layer 44 form a pattern from which vias in the underlying gate material and dielectric are patterned. The tracks may be formed by various ion tracking techniques or by other high resolution lithography. The opening or via 46 may be formed by plasma or electrochemical etching.
3. The mask layer pattern is transferred into the gate material layer 43 by etching, either wet or plasma etch techniques to form an opening or via 48 in layer 43, as shown in FIG. 9. With the gate material layer 43 composed of chromium, for example, etching is carried out by standard plasma etch techniques using $Cl_2/O_2$ chemistry or electrochemical etching techniques.
4. The mask layer 44 is removed, as shown in FIG. 10, by dissolution with appropriate solvent, such as acetone, or selective removal during subsequent plasma etch step ($Cl_2/O_2$ will remove polycarbonate film, for example). The device (layers 41–43) may have a height, as indicated by arrow 51, or 500–800 nm, for example.

5. A via or cavity indicated at 49 is etched in dielectric layer 42, as shown in FIG. 10, using a high density plasma etch system which enables small feature, high aspect ratio structures to be formed therein. The advanced (high density) plasma etching is carried out by using a $CHF_3/CF_4$ chemistry. Preferably, the plasma etch system allows control of plasma density with independent control of plasma ion energy, hence directionality, thereby allowing control of vertical etch rate over horizontal etch rate.
6. After forming the via or cavity 49 in dielectric layer 42, an emitter structure 50 is formed in the via 49 of dielectric layer 42 and which extends into via 48 in gate material layer 43 by electroplating. The electroplating may be carried out, for example, in a nickel sulfamate plating solution. For an Al/Cr cermet resistor layer 41, plating can be enhanced by initial reduction of $Cr_2O_3$ on the surface using acidic nickel sulfate solution with a pulsed voltage waveform. FIG. 11 shows the emitter being slightly above the dielectric layer 42. By controlling the plating potential on the gate, plating will be reduced faster near the axis of the dielectric via than at its perimeter forming a sharpened emitter 50 as indicated at 51 in FIG. 11. This also tends to prevent shorting between the emitter 50 and the gate metal layer 43 during the electroplating operation.
7. The dielectric sidewall material of layer 42 is then etched back away from the emitter structure 50 to form an enlarged cavity or via 49', as shown in FIG. 12, by wet etch in 6:1 buffered hydrofluoric acid, for example.

It has thus been shown that the present invention provides electrochemical formation of field emitters, particularly sharp emitters for use in field emission cathodes such as utilized in flat panel displays. The sharp emitters are formed by electroplating and the shape of the formed emitters is controlled by the potential imposed on the gate electrode as well as the potential on a separate counter electrode. The process of this invention can be carried out using various types of dielectric materials, thus eliminating the prior need for selective etching of ion tracks in the dielectric.

While particular embodiments and sequences of operational steps, along with particular materials, parameters, energies, potentials, etc., have been set forth to exemplify and describe the principles of the invention, such are not intended to be limiting. Modifications and changes may become apparent to those skilled in the art, and it is intended that the invention be limited only by the scope of the appended claims.

The invention claimed is:

1. In a process for forming field emitting points in a gated field emitter structure, the improvement comprising:

forming the field emitting points using an electroplating technique with one electrode at a lower potential than the potential on another electrode, the electroplating being carried out using a gate metal layer and a row metal layer of the structure as electrodes.

2. The improvement of claim 1, additionally including, controlling the configuration of the field emitting points by controlling the potential imposed on the electrodes during electroplating.

3. The improvement of claim 1, wherein the shape of the field emitting points is controlled by the potential imposed on a gate electrode and a separate counter electrode.

4. A process for electrochemical formation of field emitters in a structure composed of:

a row metal layer, a resistor layer, a dielectric layer, a gate metal layer, and a polymer layer, the process including:

forming at least one aligned opening in the polymer and gate metal layers;

removing at least a section of the dielectric layer under the at least one opening in the polymer and gate metal layers to expose at least one section of the resistor layer; and forming on the at least one exposed section of the resistor layer a field emitter by electroplating using one electrode at a potential lower than the potential of another electrode, the electroplating being carried out using the row metal layer and the gate metal layer as electrodes.

5. The process of claim 4, additionally including controlling the shape of the field emitter by controlling the potential imposed on the gate metal layer.

6. The process of claim 4, additionally including forming the dielectric layer from dielectric material having selectivity, low selectivity, and no selectivity.

7. The process of claim 6, wherein the dielectric layer is formed from material selected from the group consisting of $SiO_2$, $Si_3N_4$ and $Al_2O_3$.

8. The process of claim 4, wherein the at least one field emitter is formed from material selected from the group consisting of nickel, chromium, platinum, copper and gold.

9. The process of claim 4, wherein the thus formed at least one field emitter has a pointed configuration.

10. A process for electrochemical formation of field emitters in a structure including at least: a layer of conductive/resistive material, a layer of dielectric material, a layer of gate material, and a layer of mask material, the process including:

forming at least one via in the layer of mask material, the layer of gate material, and the layer of dielectric material, removing the layer of mask material, and forming a field emitter in the at least one via in the dielectric material layer by electroplating using one electrode at a potential lower than the potential of another electrode, the electroplating being carried out using the gate material layer as an electrode and the layer of conductive/resistive material as another electrode.

* * * * *